US008770430B2

(12) United States Patent
Nyeboer et al.

(10) Patent No.: US 8,770,430 B2
(45) Date of Patent: Jul. 8, 2014

(54) CONTAINER HAVING SLIDING SUPPORT MEMBERS

(75) Inventors: Calvin D. Nyeboer, Holland, MI (US); Mark J. Feenstra, Grand Haven, MI (US)

(73) Assignee: Bradford Company, Holland, MI (US)

( * ) Notice: Subject to any disclaimer, the term of this patent is extended or adjusted under 35 U.S.C. 154(b) by 376 days.

(21) Appl. No.: 13/198,245

(22) Filed: Aug. 4, 2011

(65) Prior Publication Data

US 2011/0284551 A1 Nov. 24, 2011

Related U.S. Application Data

(62) Division of application No. 11/122,686, filed on May 5, 2005, now abandoned.

(51) Int. Cl.
*B65D 21/02* (2006.01)

(52) U.S. Cl.
USPC .... 220/503; 220/1.6; 220/23.86; 220/495.01; 220/528; 206/485

(58) Field of Classification Search
USPC ..... 220/1.5, 1.6, 23.83, 23.86, 495.01, 720, 220/544, 531, 529, 534, 535, 528, 503, 220/507; 206/485
See application file for complete search history.

(56) References Cited

U.S. PATENT DOCUMENTS

| | | | | |
|---|---|---|---|---|
| 634,589 | A | 10/1899 | Russell | |
| 1,712,168 | A | 5/1929 | Rand, Jr. | |
| 4,527,694 | A | 7/1985 | Bolt et al. | |
| 4,685,571 | A | 8/1987 | Hoss | |
| 4,770,314 | A | 9/1988 | Giesler | |
| 4,864,686 | A | 9/1989 | Lasier et al. | |
| 5,238,139 | A | 8/1993 | Bisceglia | |
| 5,324,105 | A | 6/1994 | Christensen | |
| 5,407,262 | A | 4/1995 | Christian et al. | |
| 5,560,507 | A | 10/1996 | Arpin et al. | |
| 5,725,119 | A | 3/1998 | Bradford et al. | |
| 5,813,566 | A | 9/1998 | Bradford et al. | |
| 5,815,903 | A | 10/1998 | Foster et al. | |
| 6,062,410 | A | 5/2000 | Bradford et al. | |
| 6,164,440 | A | 12/2000 | Van Bree | |
| 6,202,884 | B1 | 3/2001 | Verkerke | |
| 6,230,916 | B1 | 5/2001 | Bradford et al. | |
| 6,497,542 | B1 * | 12/2002 | Vermeulen | 410/43 |
| 6,540,096 | B1 | 4/2003 | Bazany et al. | |
| 7,125,062 | B2 | 10/2006 | Kiester et al. | |
| 7,748,559 | B2 | 7/2010 | Bradford | |

(Continued)

FOREIGN PATENT DOCUMENTS

| | | |
|---|---|---|
| DE | 1954166 | 3/1997 |
| DE | 20101374 | 4/2001 |

(Continued)

*Primary Examiner* — Stephen Castellano
(74) *Attorney, Agent, or Firm* — Wood, Herron & Evans, LLP

(57) ABSTRACT

The present invention provides a container for holding product therein during shipment and being returned for reuse that has a body, tracks attached to opposite sides of the body, and a plurality of support members supported by the tracks. Rollers are located at the ends of the support members which roll in the tracks to move the support members. The support members have product receptacles whereby products may be suspended between adjacent support members, portions of the products residing in the product receptacles.

20 Claims, 11 Drawing Sheets

(56) References Cited

U.S. PATENT DOCUMENTS

| | | | | |
|---|---|---|---|---|
| 7,762,422 | B2 | 7/2010 | Dobrinski | |
| 8,100,282 | B2 | 1/2012 | Nyeboer et al. | |
| 8,308,015 | B2 * | 11/2012 | Bradford et al. | 220/529 |

FOREIGN PATENT DOCUMENTS

| | | |
|---|---|---|
| FR | 1455414 | 4/1966 |
| FR | 2860504 | 4/2005 |
| JP | 6-59230 | 8/1994 |

* cited by examiner

CONTAINER HAVING SLIDING SUPPORT MEMBERS

CROSS REFERENCE TO RELATED APPLICATIONS

This application is a divisional of U.S. patent application Ser. No. 11/122,686 filed May 5, 2005 now abandoned entitled "Container Having Sliding Support Members" which is fully incorporated herein.

FIELD OF THE INVENTION

The present invention relates to containers for use in shipping and, more particularly, to containers with movable members for supporting product.

BACKGROUND OF THE INVENTION

A large number of different container structures are utilized by manufacturers to ship a variety of different products to end users, which may be, for example, assembly plants. In the automobile industry, for example, an assembly plant assembling a particular automobile might utilize a number of different parts from different manufacturers. These manufacturers ship their respective parts to the assembly plant in container structures where the parts are then removed from dunnage or support members inside the container structure and assembled into a finished automobile.

Access to the product in the containers is of particular concern. Specifically, in the automotive industry, the containers full of product are positioned on an assembly line adjacent to a work area which is associated with a particular product to be installed on a manufactured vehicle. For example, a container full of interior door panels is usually positioned next to a particular station on an assembly line where interior door panels are installed so that a line worker may easily access the door panels inside the container. The product or part is taken directly from the container and used on the line. Some existing containers are difficult to access which makes removal of the parts therein difficult and time consuming. For example, some containers are configured so that a line worker must walk around the container to remove parts or products from opposite ends of the container. As may be appreciated, a line worker only has a certain amount of time to install a part. Any delay in access and removal of the part from the container is undesirable.

In many containers, a line worker or employee must insert or remove parts from a distal or rear part of the container. The size and/or weight of the parts or work pieces may cause stress or strain on the line worker and, more particularly, on the back of the worker when inserting or removing parts from such a container. Such ergonomically unfriendly movements may cause physical trauma, pain and other injuries that may lead to lost production time.

In some situations, in order to alleviate such stress and/or strain on his or her body, the line worker may move to the rear or opposite end of the container to remove parts from inside the container. This requires space around the container which may not be available, depending on the physical layout of the plant or facility. The length (front to back) of certain containers may be limited because the container manufacturer needs to eliminate the need for a line worker to walk around the container to remove product from inside the container. Such containers having a reduced length reduce the number of parts or products which may be shipped and/or stored in the container. The more containers needed to ship a predetermined number of parts, the greater the cost to the shipper.

In other containers, such as containers having multiple layers or level of parts, a line worker or employee must lean forward and bend down into the container to insert or remove a part or work piece from the bottom of the container. This movement by the line worker is ergonomically unfriendly because the line worker must lean forward and bend down into the container to insert or remove a part or work piece from the bottom of the container. This movement is necessary with many top loading containers.

Depending upon the number of times the line worker repeats this unnatural motion into the interior of the container, strain in the back, legs and arms may result. The size and/or weight of the parts or work pieces may increase the strain on the line worker. Thus, simply removing multiple parts during a work day may cause physical trauma, pain and other injuries that may lead to lost production time.

Accordingly, there is a need for a container which prevents employees from walking around the container to insert or remove product from inside the container.

There is further a need for a container which prevents employees from having to perform difficult or straining repetitive reaching motions.

There is further a need for a container which brings product into an ergonomically friendly area or zone for insertion or removal of the product.

There is further a need for a container which may be designed for a particular application with increased product density.

SUMMARY OF THE INVENTION

The present invention provides a container for holding product therein during shipment that has a body, tracks or retainers supported by the body, and a plurality of support members that are supported by the tracks. For purposes of the present invention, the term "support member" is not intended to be limited to a unitary member, but may include multiple components secured together to form a "support member." For example, a "support member" may comprise in combination a wooden bar and a fabric cover surrounding the wooden bar. Any number of such combinations is possible with the present invention.

In one embodiment, at least some of the support members have rollers attached to their ends. The rollers are adapted to roll in the tracks or retainers. The support members also have a plurality of product receptacles whereby products may be suspended between the support members. Typically, a portion of the product resides in or is secured in the product receptacles. These product receptacles or notches may be particularly sized and located as to mate or correspond with a portion of a particular product or a particular appendage of a product.

The container may also include at least one space limiter attached to the support members to limit the distance adjacent support members may be moved or separated from each other. One acceptable space limiter is a plastic strap or like component that can flex when the distance between the support members is minimized and yet only allow the support members to move a predetermined distance apart from each other. Other materials may be used if desired.

The container further comprises stabilizers which act on the support members to prevent their rotation. These stabilizers, which may be solid rods or hollow tubes or like components in one embodiment of the present invention, pass through apertures or holes in the support members and allow the support members to freely slide along or over the stabilizers. However, the stabilizers, while allowing the support members to move along or over them, prevent the support members from rotating relative to a horizontal axis. Hence, the stabilizers insure that the support members remain in a generally vertical orientation at all times so that product does not fall between adjacent support members due to rotation of one or more of the support members. In alternative embodiments, the stabilizers may not pass through the support members, but rather be operatively coupled to them in any desired manner or fashion. For example, the stabilizers may pass through clips or retainers secured to the support members.

The container of the present invention is adapted so that an operator located at the front of the container may pull product to be emptied from the rear of the container forwardly to a more ergonomically friendly position after a row of products suspended by and contacting the two forwardmost support members, named proximal and medial support members for purposes of this document, have been unloaded or removed. Thus, a person unloading the container from the front or proximal location of the container will not have to stretch or reach to the back of the container to unload remaining product.

Similarly, a person loading the container from the front of the container need not stretch or reach to the back of the container to insert or load product into the container. The loader of the container may push the support members already loaded with rows of product rearwardly and load additional product in a more ergonomically friendly position or manner. For example, after a row of products is loaded between two support members, i.e., a distal or first and second or medial support member, these support members are pushed rearwardly to enable the loader to load an additional row of product between the medial support member and a third or proximal support member. Thus, the present invention allows product to be more efficiently and safely removed from these containers or inserted therein without unnecessary stress or strain on the unloader or loader.

Moreover, because the product receptacles are located at or near the top of the support members, products may be easily accessed. In other words, the product receptacles keep the product in an optimum location for removal by an unloader or insertion by a loader.

In an alternative embodiment of the present invention, the rollers are omitted from the support member assemblies. In this embodiment, the sides of the container body need not have tracks or retainers. The support members slide along stabilizers which are secured to opposed sides of the container body.

In alternative embodiments of the present invention, a plurality of tracks or retainers is attached to the body of a container at different heights whereby multiple layers or levels of product may be shipped in a single reusable and returnable container. This allows for maximizing the number of parts which may be shipped in a container, as well as ensuring that the product will be able to be moved to an ergonomically friendly area or zone within the container prior to its removal by an unloader and/or insertion by a loader. For example, once an upper layer of product is removed, all the support members of the upper layer may be pushed to the rear of the container, thus exposing a lower layer of product residing on a lower set of slidable support members. The lower layer of product may be removed and the lower support members continually moved toward the unloader to insure that the lower layer of product remains as close as possible to the unloader prior to it being unloaded. Similarly, once a lower layer of product is loaded or inserted into the container, another upper layer of products may be loaded in a manner which does not cause unnecessary stress or strain on the body of the individual loading the container. The container of the present invention is not limited to two layers; the container may have any number of such layers.

According to the method of the present invention for unloading a product from a container, an unloader first removes product suspended between opposing product receptacles, a first product receptacle being located in a proximal support member and a second product receptacle being located in a medial support member. Once all the product that is suspended between the proximal and medial support members has been removed, the medial support member is rolled or moved alongside the proximal support member so that both members are located nearest to the front of the container, i.e., where the unloader is positioned. The unloader then removes the next row of product that is suspended between product receptacles in the medial member and product receptacles of a distal member. Once all the product in this row is removed, the distal member is rolled or moved to position nearest to the unloader, i.e., alongside the medial member. If the container contains additional support members, the process continues until all rows of the container have been unloaded.

Similarly, product may be easily and quickly loaded into a reusable and returnable container using the present invention. A loader first loads product so that the product is suspended between opposing product receptacles, the first product receptacle being located in a distal support member and the second product receptacle being located in a medial support member. Once a row of product has been suspended between the distal and medial support members, the distal and medial support members are rolled or moved away from the loader so that another row of products may be loaded into the receptacles of the next two support members, a proximal support member and the medial support member. The loader then inserts the next row of product so that it is suspended between product receptacles of the proximal and medial support members. Once all the product in this row is inserted, the proximal and medial support members are rolled or moved away from the loader, i.e., to the rear of the container. If the container contains additional support members, the process continues until all support members of the container have been loaded with product being suspended therefrom.

In an alternative embodiment of the present invention that contains multiple layers of product, after the upper layer or level of products have been removed or unloaded, the unloading process continues by moving all of the upper support members, i.e., the proximal, medial and distal members, to a position that is farthest from the unloader. A lower layer of product is thus exposed and an unloader may remove additional product that is suspended between product receptacles in a lower proximal support member and product receptacles of a lower medial support member. Once all products in this lower row are removed, the lower medial member is rolled alongside the lower proximal member so that both members are positioned nearest to the unloader. The unloader may then remove additional product suspended between product receptacles of a lower medial member and product receptacles of a lower distal member. The unloader continues the process of unloading rows of product and sliding, rolling or moving the support members towards the unloader until all products in that particular layer have been unloaded. Any number of layers of product may be unloaded in such a manner.

In this alternative embodiment, the method of loading the container that contains multiple layers of product comprises loading one layer at a time. The process begins by moving all of the upper support members, i.e., the proximal, medial and distal support members for supporting the upper layer of product to a position that is farthest from the unloader so they don't interfere with loading the lower layer. A lower layer of support members is thus exposed and a loader may insert product between the support members of the lower layer so that the product is suspended between product receptacles of these lower support members. Once all of the product receptacles in the support members of this lower layer have been fully loaded or filled, the upper support members are moved to the front of the container proximate the loader. The loader may then insert additional product between the upper support members, the additional products being suspended by product receptacles formed in the upper support members. The loader continues the process of loading rows of product and sliding, rolling or moving the support members away from the loader until all product in that particular upper layer has been loaded. Any number of layers of product may be loaded in such a manner.

The above and other objects and advantages of the present invention shall be made apparent from the accompanying drawings and the brief description thereof.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the invention.

DETAILED DESCRIPTION OF THE INVENTION

Figure 1:
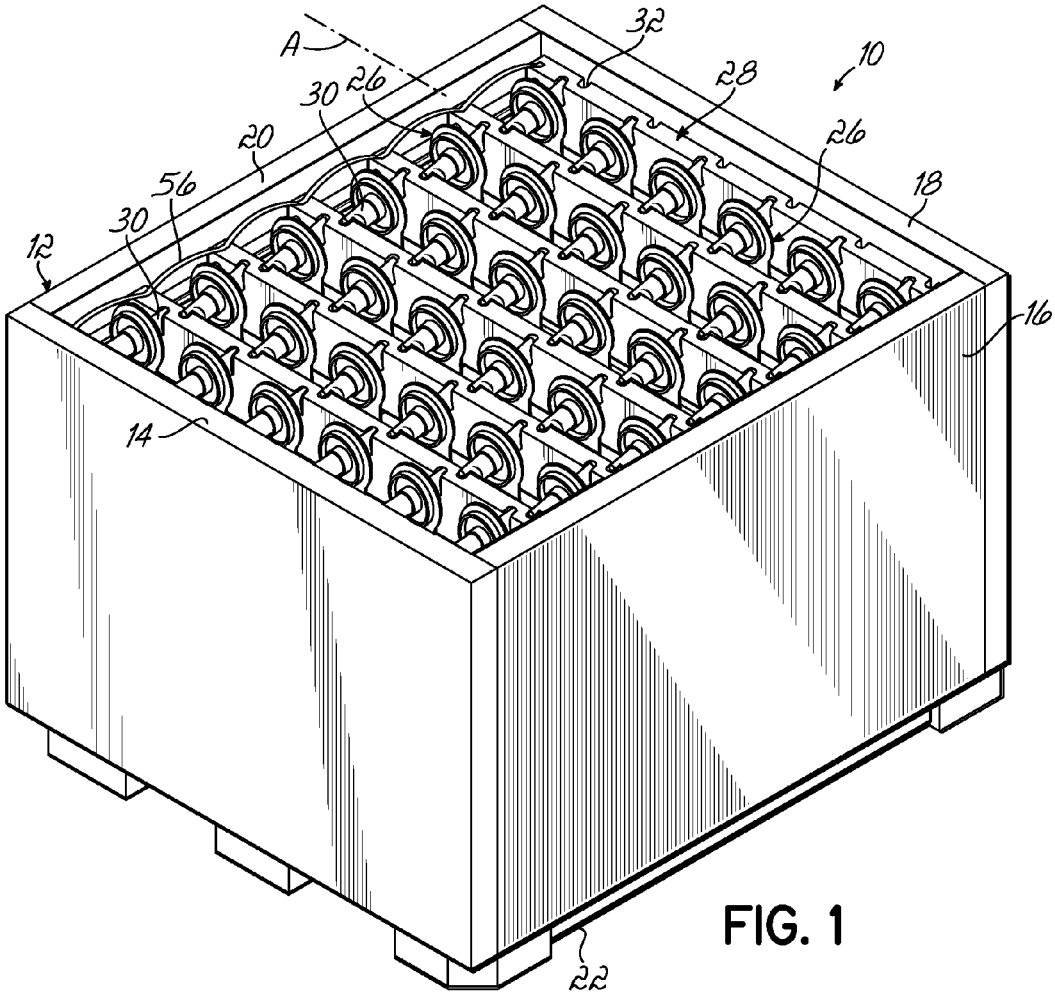
FIG. 1 is a perspective view of a preferred embodiment of the reusable and returnable container of the present invention showing product being suspended by a plurality of support members.

Referring to FIG. 1, there is illustrated a reusable and returnable container 10 according to one embodiment of the present invention. The reusable and returnable container 10, as shown, comprises a body 12 having a front wall 14, a side wall 16, a rear wall 18 and another side wall 20, all extending upwardly from a base 22. Although one type of container is illustrated, the present invention may be used with any type or configuration of box or container. For example, the present invention may be used in a container in which one or more of the walls of the container are hinged for the container to be more easily erected and/or compacted for storage. The present invention may also be used in a rack type of container which has four corner posts extending upwardly from a base. A cover (not shown) may also be included to enclose the container 10 and further protect and secure product 26 during shipment.

Product 26 is suspended by and supported by a plurality of support members 28. Although one configuration of support member 28 is illustrated, the present invention may be used with any type or configuration of support member. A portion or appendage 30 of the product 26 is specifically received in and/or secured in a product receptacle 32 in one support member 28 and another portion or appendage 30 of the same product 26 is located in a product receptacle 32 of an adjacent support member 28. See FIG. 2. These product receptacles or notches 32 are particularly machined or sized and located to receive, mate and/or hold the portion or appendages 30 of the product 26. The product receptacles furthermore are located and sized so that a specific number of products may fit snugly inside the container 10 without moving or shifting during shipment. Although one configuration of product 26 is illustrated and described, the present invention may be used to store and ship other configurations of product not shown or described. Similarly, depending on the configuration of the product, the product receptacles or notches formed in the support members may be shaped or configured differently than those shown and described.

Figure 5A:
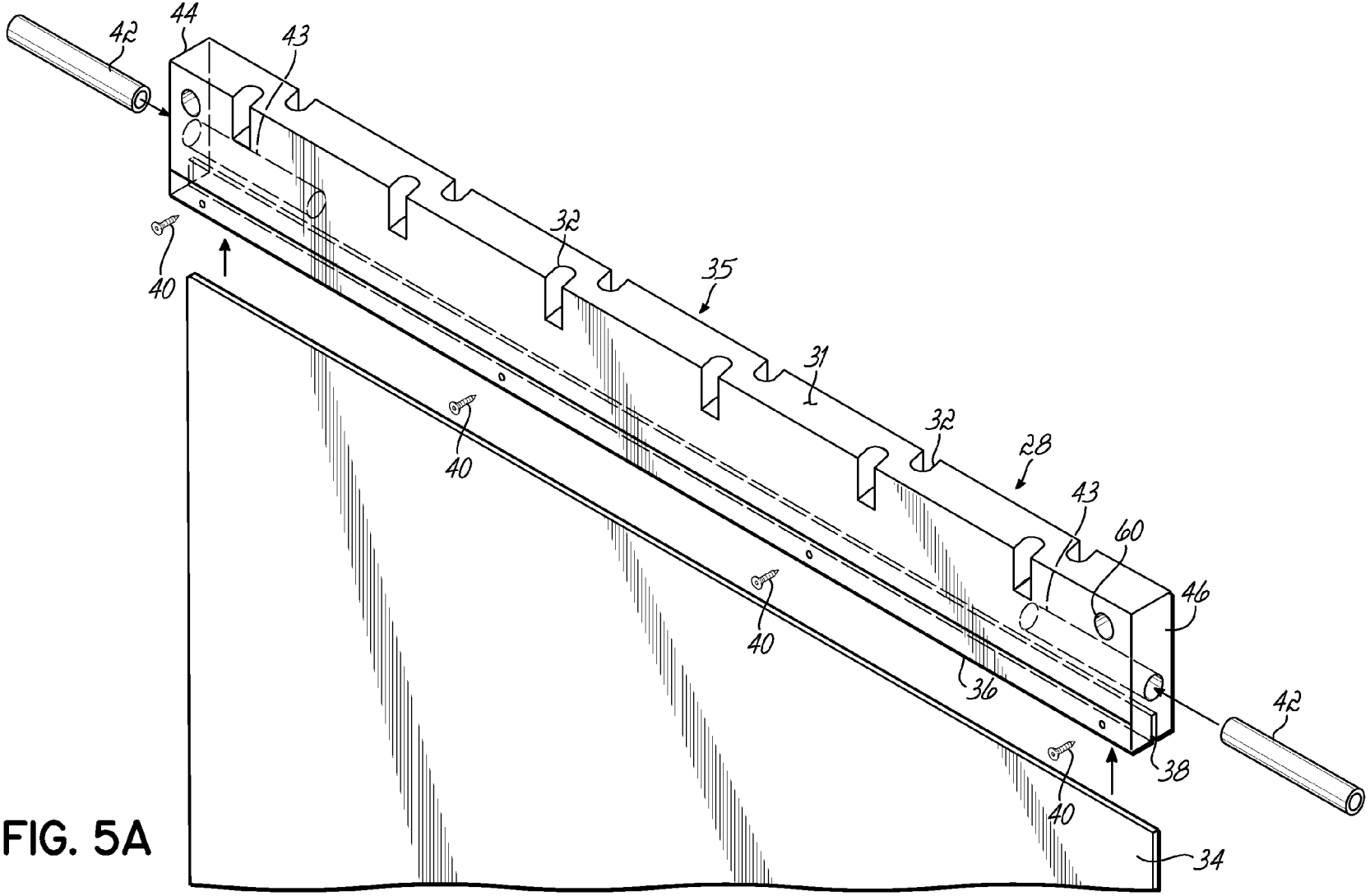
FIG. 5A is a partially disassembled perspective view of a portion of one of the support member assemblies shown in FIGS. 1-4.

As shown in FIGS. 1A, 5A, 5B and 5C, a support member assembly 35 includes a divider 34 attached to the bottom 36 of the support member 28 and suspended therefrom. As shown in FIG. 5A, the divider 34 may be mounted to the lower end 36 of the support member 28 by being inserted into a longitudinally extending groove 38 formed in the support member 28 and secured therein with a plurality of fasteners 40, such as screws, rivets, nails or the like. An adhesive, such as glue, may also be used to help secure the divider 34 to the support member 28, if desired. Any other suitable means of securing the divider 34 to the support member 28 may be used as desired. The dividers 34 prevent adjacent product 26 from contacting one another and being dented or otherwise damaged.

Figure 5B:
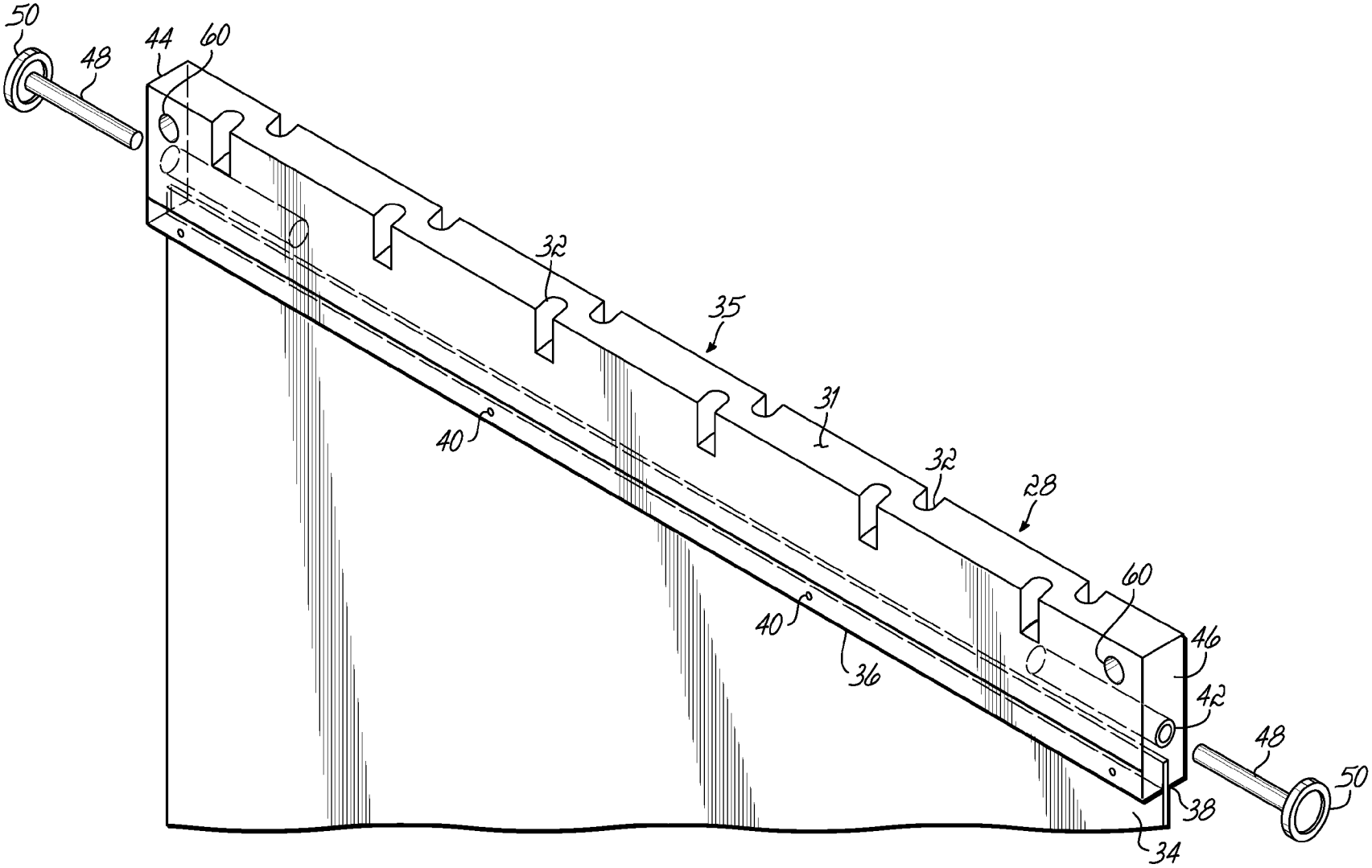
FIG. 5B is a partially disassembled perspective view of the support member assembly shown in FIG. 5A including rollers at each end of the support member.
Figure 5C:
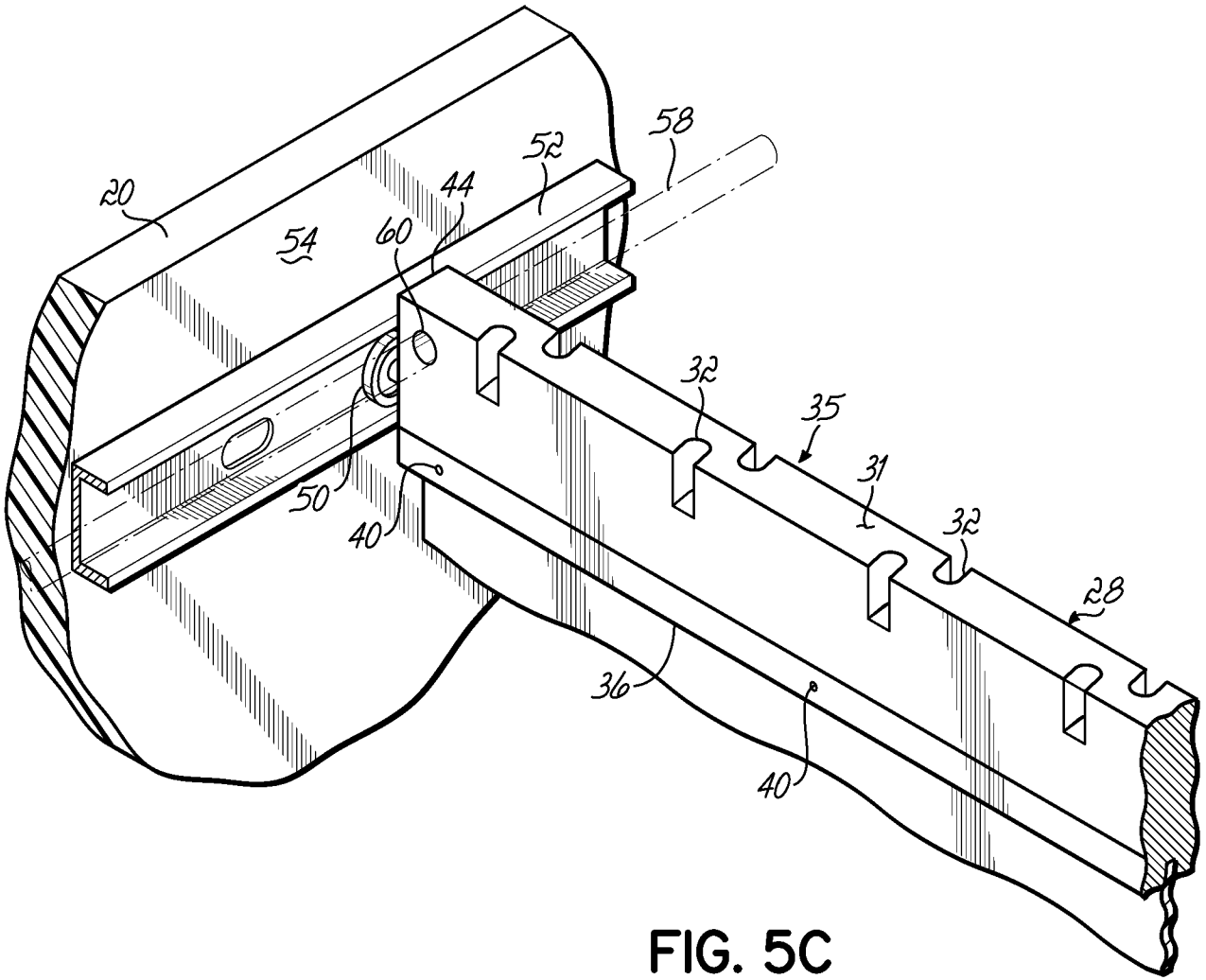
FIG. 5C is a perspective view of a portion of the support member assembly shown in FIGS. 5A and 5B showing the roller at the end of the support member being in a track attached to the body of the container.

As also shown in FIG. 5A, tubes 42 are inserted in holes 43 formed in opposed ends 44, 46 of the support member 28 to further complete the support member assembly 35. As shown in FIG. 5B, these hollow tubes 42 are used as receptacles for rotatably receiving the axles 48 of the rollers 50. As shown in FIG. 5C, rollers 50 are adapted to roll or move in channels or tracks 52 attached to the interior surfaces 54 of the side walls 20, 16 of the container 10. FIG. 5C illustrates one roller 50 at end 44 of the support member 28 rotatably received in a track 54 secured to side wall 20. A roller 50 at the other end 46 of the support member 28 is likewise supported in a track 52 which is attached to side wall 16 of the container 10. Although one configuration of track 52 and roller 50 is shown and described, other types of rollers and tracks may be used, if desired, such as the one illustrated in FIG. 5D.

Figure 2:
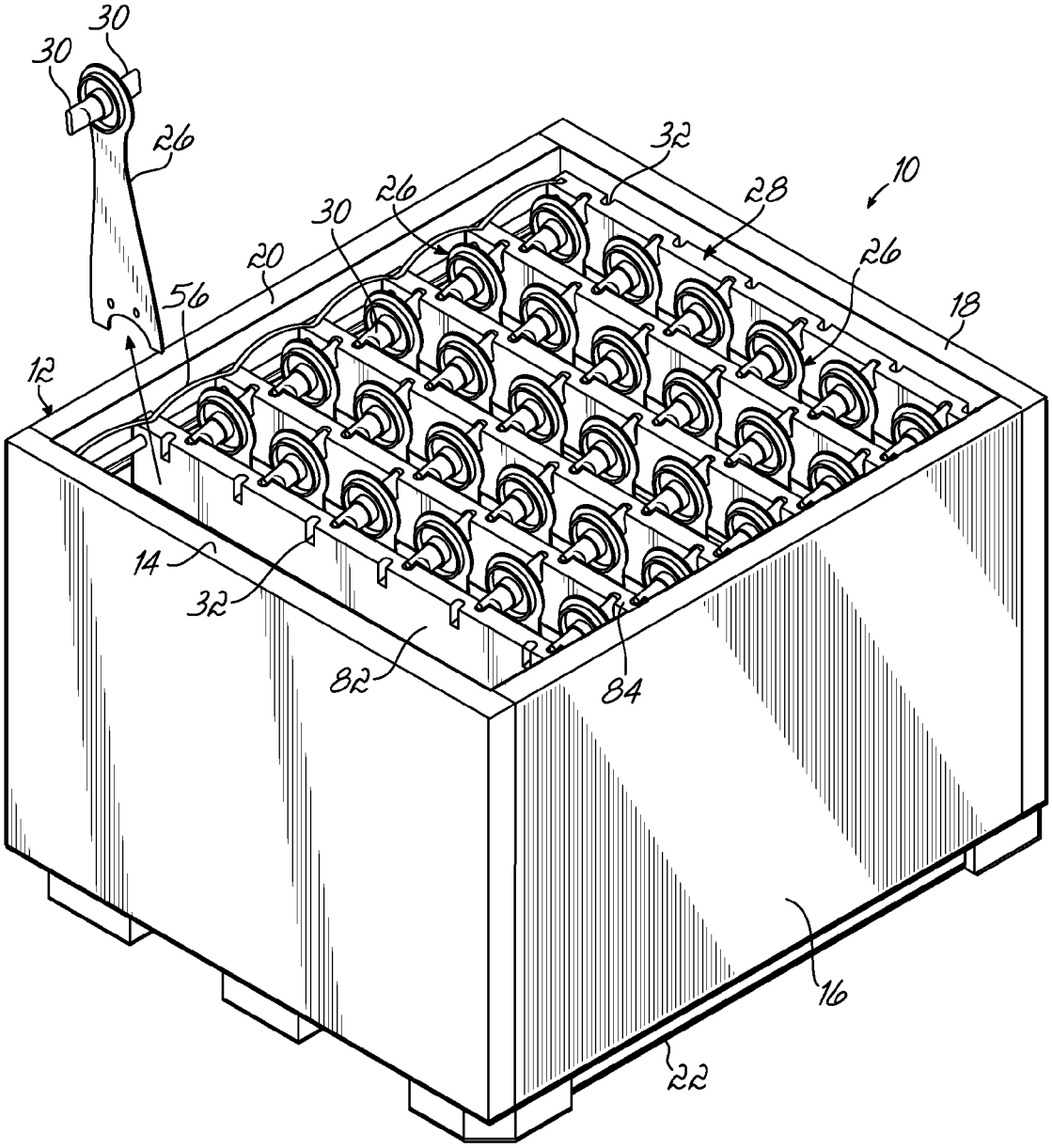
FIG. 2 is a perspective view of the reusable and returnable container shown in FIGS. 1 and 1A showing a product being removed from the container.
Figure 3:
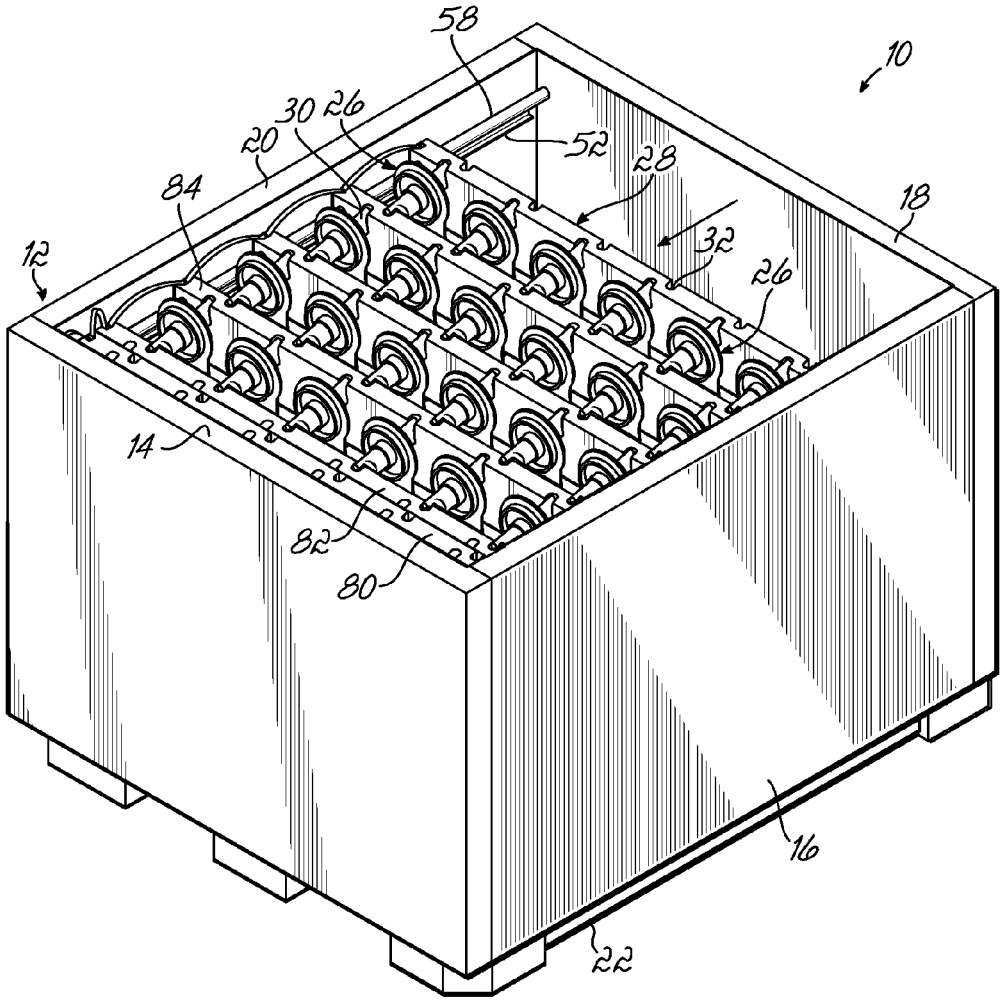
FIG. 3 is a perspective view of the reusable and returnable container shown in FIGS. 1-2 after all product has been removed between two adjacent support members and the remaining support members have been moved toward the front of the container.
Figure 4:
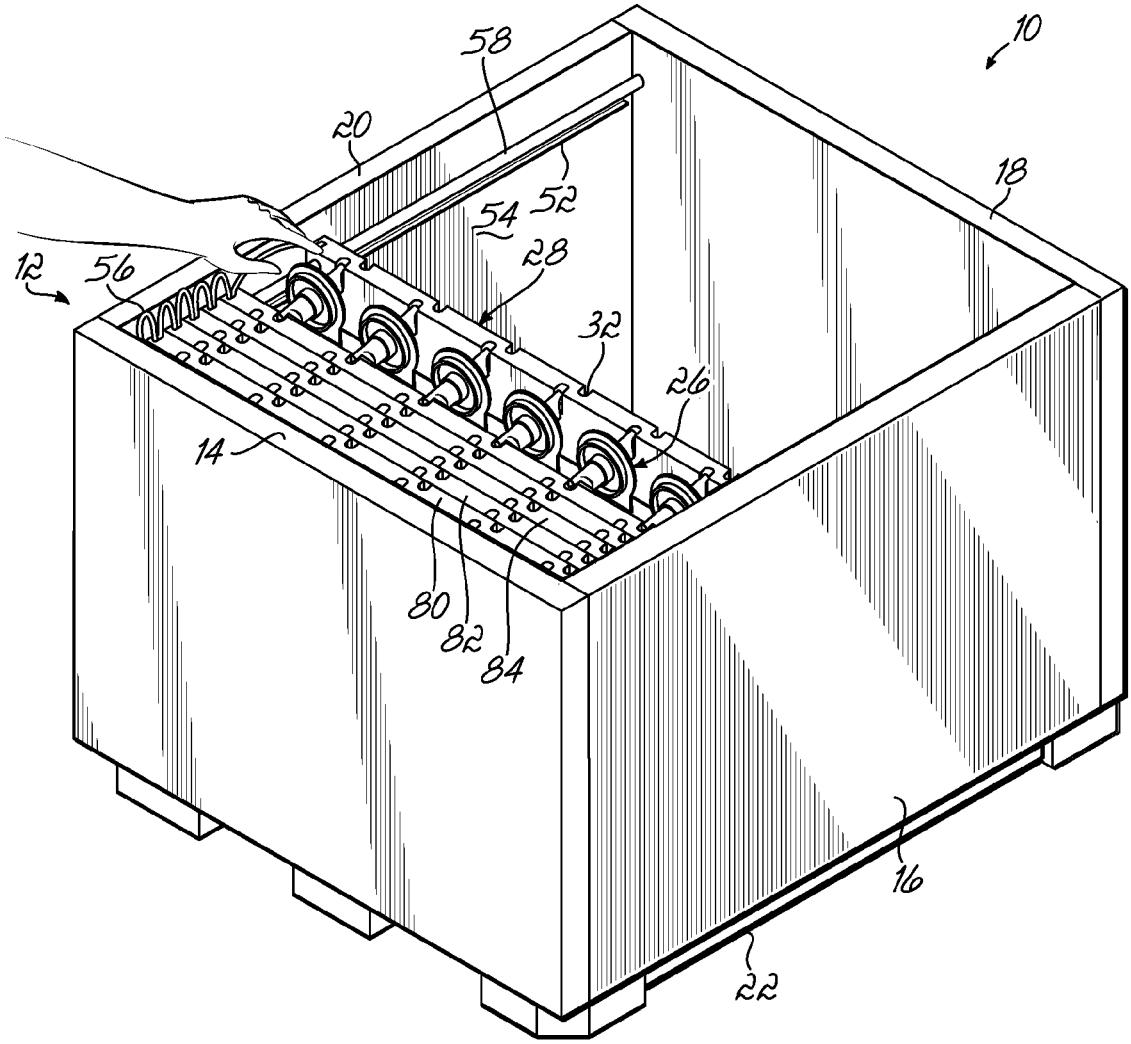
FIG. 4 is a perspective view of the reusable and returnable container shown in FIGS. 1-3 after all but one row of product has been removed and the support members have been moved to the front of the container.

According to another aspect of the present invention, the reusable and returnable container 10 may also have at least one space limiter 56 which, as shown in FIGS. 1, 2 and 3, limits the distance the support members 28 may be moved away from one another due to the fact that each space limiter 56 is secured to each support member 28. Typically, the length or distance of the space limiter 56 between locations where the space limiter 56 is secured to the support members 28 will be fixed to prevent the support members 28 from moving farther apart than necessary for the insertion of product 26 between adjacent support members 28. The space limiter 56 may be secured to the upper surfaces 31 of the support members 28 in any suitable fashion including but not limited to gluing, fastening, etc. Of course, when the support members 28 are moved or rolled to a position adjacent to one another, i.e., in contact, as shown in FIG. 4, the flexibility of the space limiter 56 allows for such movement. The space limiter 56, as shown, is preferably comprised of a plastic strap, but may be made of any other suitable material.

Figure 1A:
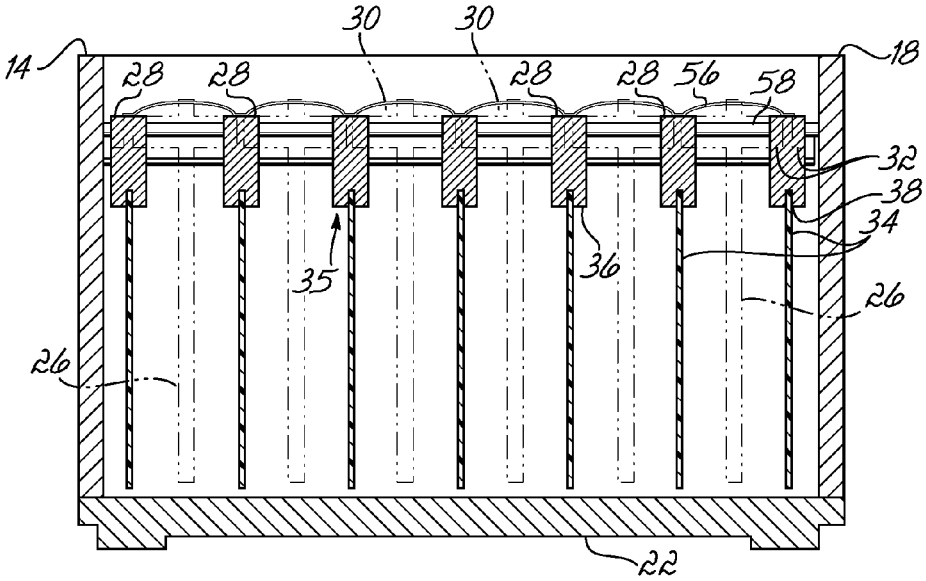
FIG. 1A is a cross-sectional view of the reusable and returnable container shown in FIG. 1 with the product shown in dashed lines.

The embodiment of the container 10 shown in FIG. 1A also has a pair of stabilizers 58. Each stabilizer 58 passes through an aperture or opening 60 in each of the support members 28. The stabilizers 58 are positioned within the apertures 60 of the support members 28 so that the support members 28 may freely slide back and forth relative to the stabilizers 58. See FIG. 5A. The stabilizers 58 may or may not be attached to the walls of the container 10. The stabilizers 58 prevent the support members 28 from rotating relative to a horizontal axis A. See FIG. 1. If one or more of the support members 28 were to rotate, the distance between adjacent product receptacles 32 could decrease due to such rotation, thereby allowing product 26 to become dislodged from the support members 28 and fall between adjacent support members 28 inside the container 10. In the embodiment shown, each stabilizer 58 comprises a rod or a tube, or the like. However, it may be any other mechanism which prevents or inhibits rotation of the support members 28.

Figure 6:
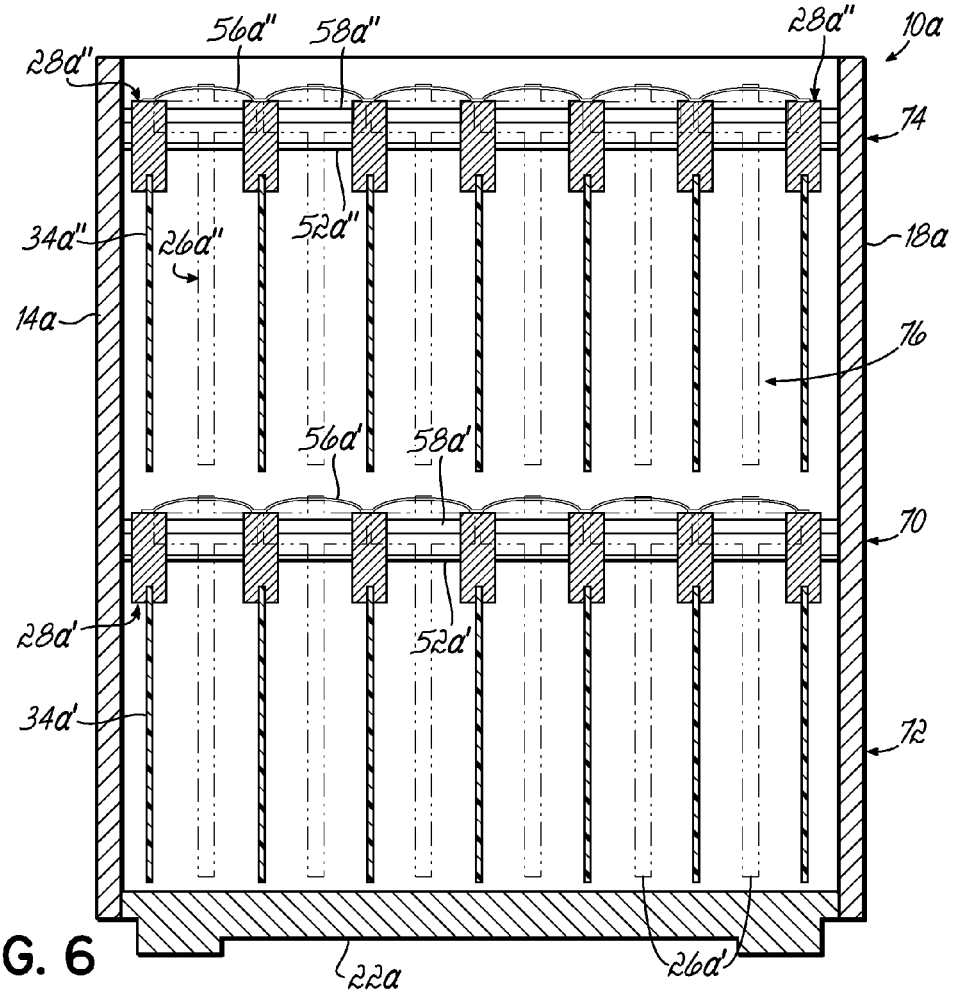
FIG. 6 is a cross-sectional view of an alternative embodiment of a reusable and returnable container having multiple layers of product.

An alternative embodiment of container 10*a* having a front wall 14*a*, a side wall (not shown), a rear wall 18*a* and another side wall (not shown), all extending upwardly from a base 22*a* is shown in FIG. 6. This container 10*a* has multiple layers of product suspended from support members 28*a*', 28*a*" having product receptacles (not shown), the support members 28*a*', 28*a*" being supported by sets of parallel tracks 52*a*', 52*a*" as described above. In this embodiment, a lower layer 70 of support members 28*a*' are adapted to move from back to front inside the interior of the container 10*a* in a manner described above. Lower stabilizers 58*a*' pass through holes in the support members 28*a*' as described above. Dividers 34*a*' are secured to and extend downwardly from the support members 28*a*' as described above. Lower space limiters 56*a*' limit the distance the support members 28*a*' may separate from each other. A lower layer 72 of product 26*a*' are supported from the lower support members 28*a*' in a manner described hereinabove.

An upper layer 74 of support members 28*a*" is adapted to move from back to front inside the interior of the container 10*a* in a manner described above. Upper stabilizers 58*a*" pass through holes in the support members 28*a*", as described above. Dividers 34*a*" are secured to and extend downwardly from the support members 28*a*" as described above. Lower space limiters 56*a*" limit the distance the support members 28*a*" may separate from each other. An upper layer 76 of product 26*a*" is supported from the upper support members 28*a*" in a manner described hereinabove.

In any of the embodiments of the present invention, the front wall of the container, the one closest to the loader or unloader, may be configured so as to allow an upper portion of the front or rear wall to open outwardly, thereby furthering access to the products 26', 26". Such an adaptation may be particularly helpful in gaining access to products in embodiments having multiple layers of product. Additionally, if desired, a portion of any of the walls of the container may be omitted or collapsible.

Figure 7:
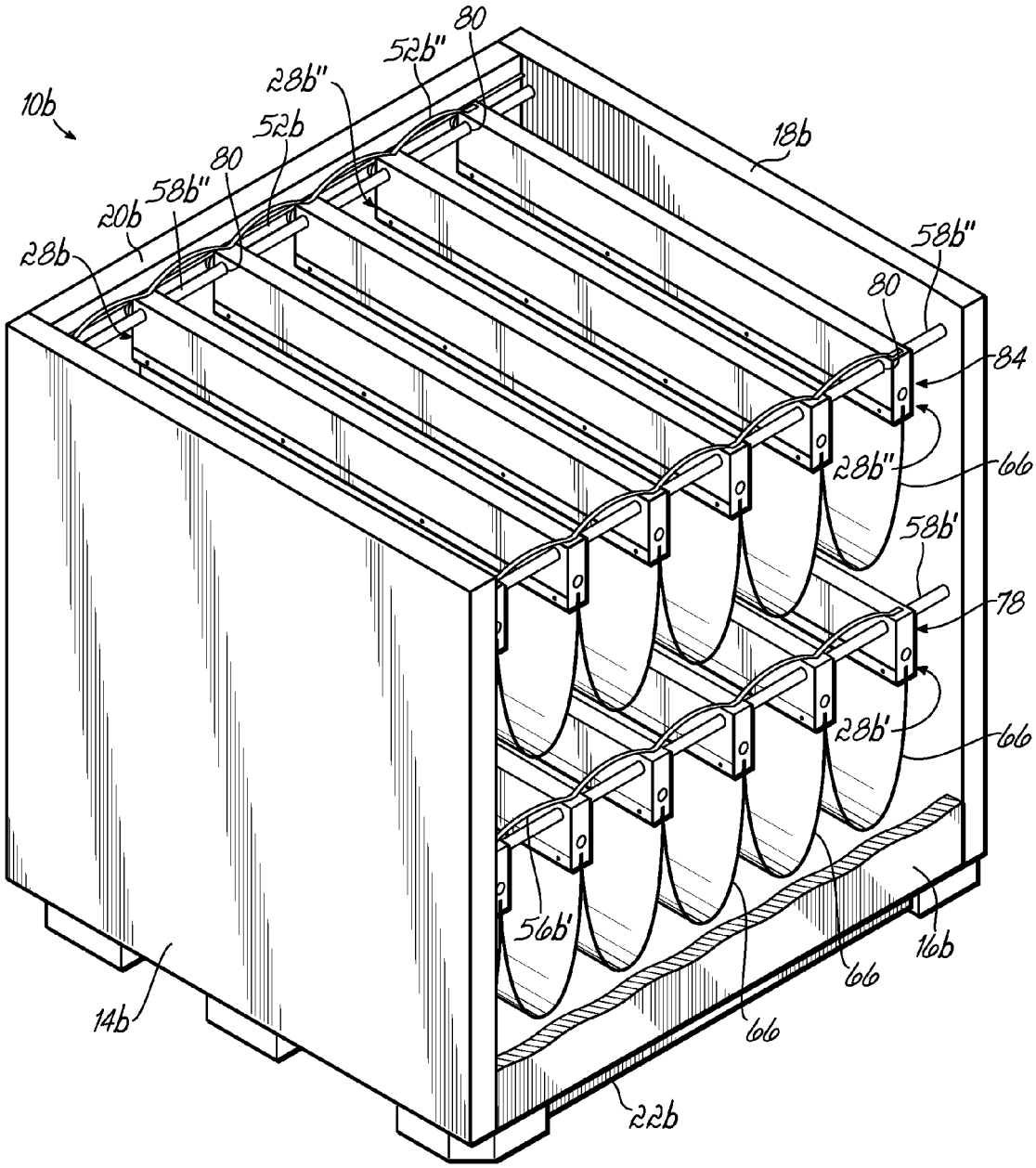
FIG. 7 is a perspective view of another embodiment of the reusable and returnable container having multiple layers of product.

FIG. 7 shows an alternative embodiment of container 10*b* having a front wall 14*b*, a side wall 16*b*, a rear wall 18*b* and another side wall 20*b*, all extending upwardly from a base 22*b*. This container 10*b*, like container 10*a* shown in FIG. 6, has multiple layers of support members 28*b* which are supported by sets of parallel tracks 52*b*. In this embodiment, the support members 28*b* preferably lack product receptacles, but may have them if desired or necessary. Product (not shown) is located in hanging pouches 66 secured to the support members 28*b* rather than suspended from the support members in the manner described above. The hanging pouches may assume other shapes or configurations if desired and may be suspended from the support members in any desired manner.

In this embodiment, a lower layer 78 of support members 28*b*' is adapted to move from back to front inside the interior of the container 10*b* in a manner described above. Lower stabilizers 58*b*' pass through holes 80 in the support members 28*b*' as described above. Lower space limiters 56*b*' limit the distance the lower support members 28*b*' may separate from each other. A lower layer 82 of products (not shown) are supported from the pouches 66 extending downwardly from the lower support members 28*b*'.

An upper layer 84 of support members 28*b*" is adapted to move from back to front inside the interior of the container 10*b* in a manner described above. Upper stabilizers 58*h*" pass through holes 80 in the support members 28*b*" as described above. Upper space limiters 56*b*" limit the distance the support members 28*b*" may separate from each other. An upper layer of products (not shown) are supported from the pouches 66 extending downwardly from the upper support members 28*b*".

Figure 5D:
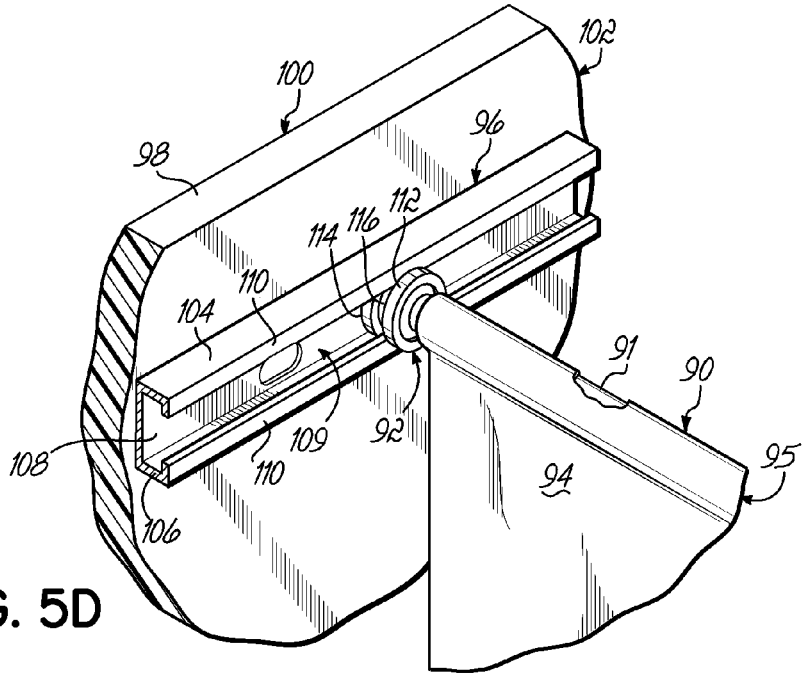
FIG. 5D is a perspective view of a portion of an alternative support member assembly showing a different type of roller at the end of the support member, the roller being in a track attached to the body of the container.

FIG. 5D shows another alternative embodiment of the present invention in which each support member 90 has a pair of opposed end members or rollers 92 (only one being shown) secured at opposed ends of a central bar 91. The end members 92 are preferably made of injection molded plastic, but may be made of any suitable material. A pouch 94, like pouch 66 shown in FIG. 7, is supported by two adjacent support members 90. The fabric of the pouch 94 is sewn or otherwise secured together to make a pocket 95 in which is located the bar 91 of the support member 90.

Tracks 96 are secured to opposed side walls 98 of the body 100 of the container 102. Each track 96 has an upper wall 104, a lower wall 106 joined to the upper wall 104 by a side wall 108 and a lip 110 extending downwardly from the upper wall 104 and another lip 110 extending upwardly from the lower wall 106 defining an interior 109 of the track 96. Each end member 92 of each support member 90 is adapted to engage and move along one of the tracks 96. Each end member 92 has a first or inside portion 112 and a second or outside portion 114 with a groove 116 therebetween. The end members 92 preferably rotate along the length or width of the tracks 96; however, the end members 92 may slide rather than rotate along the tracks 96. The outside portion 114 of the end member 92 preferably rotates inside the interior 109 of the track 96 and the inside portion 112 rotates outside of the interior 109 of the track 96, the groove 116 of the end portion 92 contacting the lips 110 of the track 96.

Although the particular track and roller arrangement or configuration illustrated in FIG. 5D is described above with respect to a hanging pouch embodiment, like the one shown in FIG. 7, it may be used in any embodiment of the present invention including, but not limited to, the embodiment illustrated in FIG. 1.

Figure 8:
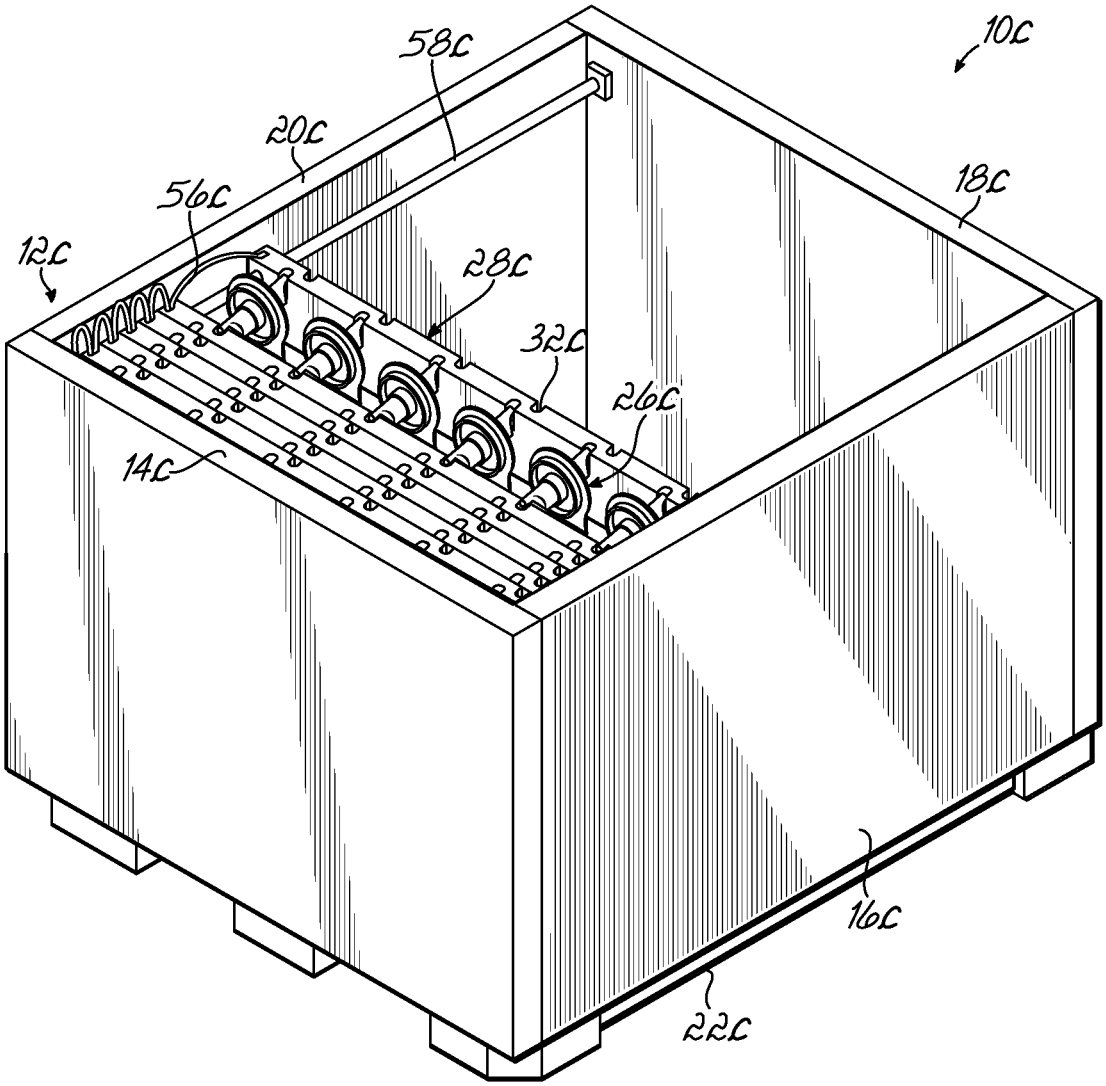
FIG. 8 is a perspective view of another embodiment of the reusable and returnable container having no rollers.

FIG. 8 shows another alternative embodiment of container 10*c* having a body 12*c* including a front wall 14*c*, a side wall 16*c*, a rear wall 18*b* and another side wall 20*c*, all extending upwardly from a base 22*c*. This container 10*c*, like container 10 shown in FIG. 1, has a single layer of support members 28*c* which are supported by stabilizers 58*c* and slidable thereon. In this embodiment, the support members 28*c* lack rollers because they are not necessary. Product 26*c* is suspended from product receptacles 32*c* formed in the support members 28*c*. Space limiters 56*c* limit the distance the support members 28*c* may separate from each other in the manner described above.

Although the embodiment shown in FIG. 8 has a single layer or level of support member assemblies, this embodiment of the present invention in which the support members lack rollers may be used in a multi-level container such as the containers shown in FIGS. 6 and 7. In such embodiments, each level of the support member assemblies slides on stabilizers, as shown in FIG. 6, but without any rollers or tracks.

Figure 9:
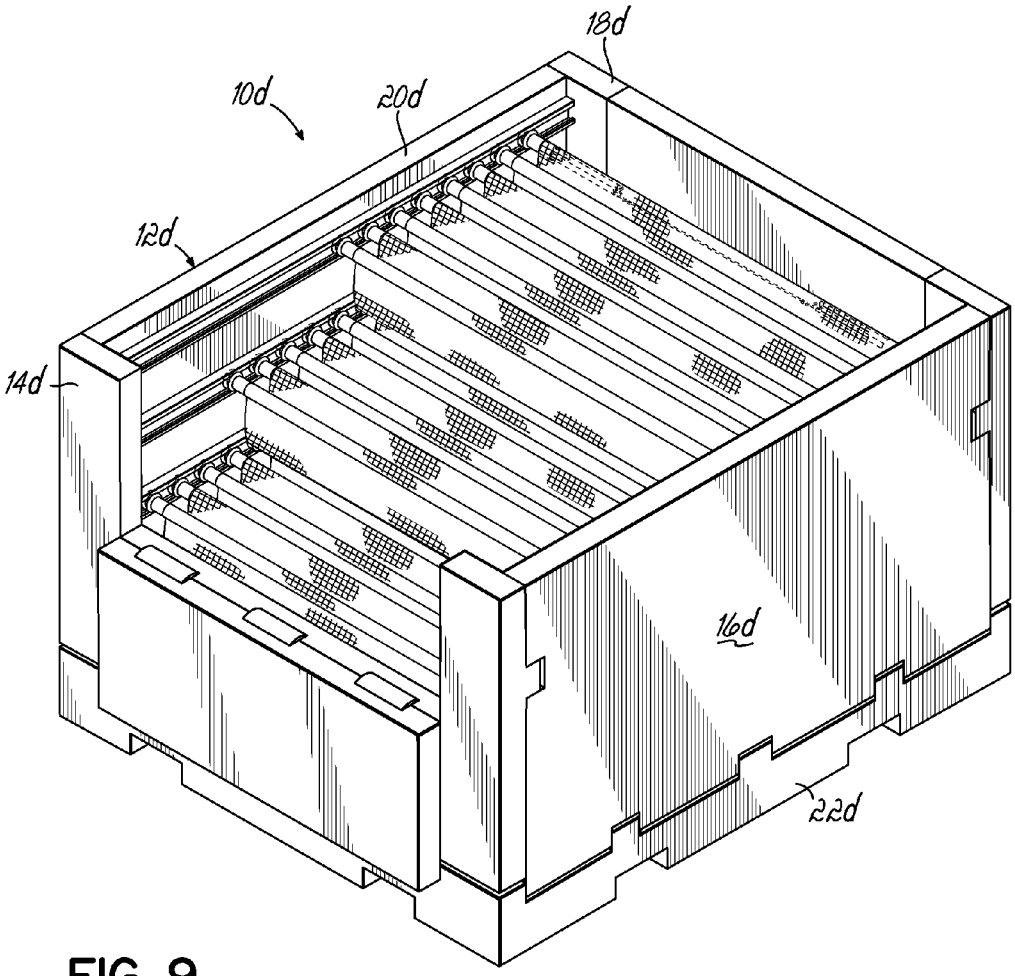
FIG. 9 is a perspective view of another embodiment of reusable and returnable container having multiple levels of dunnage and two doors.

FIG. 9 shows another alternative embodiment of container 10*d* having a body 12*d* including a front wall 14*d*, a side wall 16*d*, a rear wall 18*d* and another side wall 20*d*, all extending upwardly from a base 22*d*.

Operationally, the method of unloading product from the container 10 comprises the steps of removing a first row of product 26, as shown in FIG. 2, suspended between a first or proximal support member 80 (see FIGS. 3 and 4) and a second or medial support member 82. The second support member 82 is then moved or rolled alongside the first support member 80 so that the first and second support members 80, 82, as shown in FIG. 3, are positioned nearest to the unloader (not shown). The unloader may then remove a second row of products 26 suspended between the product receptacles of the second support member 82 and the product receptacles of a third or distal support member 84. This process continues until all product have been removed from the container 10 and all of the support members 28 are pulled forwardly and resting against one another proximate the front wall 14 of the container 10. As shown in FIG. 4, to remove the last or rearmost row of products, the operator need only reach a limited distance over the container or into the container.

In an embodiment where the container has multiple layers of product, as shown in FIGS. 6 and 7, when all product is removed from the upper layers, the upper support members may then be rolled to a position farthest from the unloader exposing a lower layer of products suspended or supported by support member assemblies, whereby the process of removing product and moving a new row of product closer to the unloader is repeated.

While various embodiments of the present invention have been illustrated and described in considerable detail, it is not the intention of the applicant to restrict or in any way limit the scope of the claims to such detail. Additional advantages and modifications will readily appear to those skilled in the art. The invention in its broader aspect is, therefore, not limited to the specific details, representative system, apparatus and method, and illustrative example shown and described. Accordingly, departures may be made from such details without departing from the spirit or scope of the applicant's general inventive concept.

What is claimed is:

1. A container for holding product therein during shipment, the container comprising:

a rectangular base;

a front wall, a rear wall and two side walls extending upwardly from the base and defining an open top, each of the side walls extending from the base to an upper edge of the open top of the container;

straight tracks supported by the two side walls at upper and lower vertically spaced levels; and a plurality of support members movable from front to back inside the container at each level and a plurality of supporting pouches for holding products at each level, each of the support members having end members at the ends thereof, the end members being adapted to move along the tracks and remaining at the same level, wherein the two side walls are adapted to prevent side access to the supporting pouches and products held therein and prevent products from inadvertently falling through a side of the container, wherein products residing in the pouches can be accessed and emptied from the pouches of the lower level when the user reaches downwardly through the open top and past the support members and supporting pouches of the upper level, the support members of the upper level being towards the rear of the container and the associated emptied supporting pouches of the upper level being collapsed.

2. The container of claim 1 further comprising at least one space limiter attached to the support members for limiting the distance adjacent support members may be spaced from each other.

3. The container of claim 1 further comprising at least one stabilizer for preventing rotation of the support members.

4. The container of claim 1 wherein at least one of the front and rear walls has a door.

5. A container for holding product therein during shipment, the container comprising:

a base;

a front wall, a rear wall and two side walls extending upwardly from the base and defining an open top, each of the side walls extending from the base to an upper edge of the open top of the container;

linear tracks supported by opposed walls at different vertically spaced levels; and a plurality of support members movable from front to back inside the container at each level and extending between opposed tracks of the same level and supporting pouches for holding products at each level, each of the support members having end members at the ends thereof, the end members being adapted to move along the tracks and remain at the same level, wherein the two side walls are adapted to prevent side access to the supporting pouches and products held therein and are adapted to prevent the products from inadvertently falling through a side of the container, wherein products residing in the pouches can be accessed and emptied from the pouches of a lower level when the user reaches downwardly through the open top and past the support members and supporting pouches of an upper level, the support members and supporting pouches of the upper level being moved towards the rear of the container.

6. The container of claim 5 further comprising at least one space limiter attached to the support members for limiting the distance adjacent support members may be spaced from each other.

7. The container of claim 5 wherein the end members are rollers for rolling in the tracks.

8. The container of claim 5 wherein the end members are made of plastic.

9. The container of claim 5 wherein at least one of the front and rear walls has a door.

10. A container for holding product therein during shipment, the container comprising:

a rectangular base;

a front wall, a rear wall and two side walls extending upwardly from the base and defining an open top, each of the side walls extending from the base to an upper edge of the open top of the container;

a plurality of linear tracks supported by the side walls at different vertically spaced levels;

a plurality of support members movable from front to back inside the container at each level, each of the support members having end members attached thereto, the end members adapted to move and remain in the tracks of the same level;

a plurality of pouches hanging from the support members at each level for holding products, wherein the two side walls are adapted to prevent side access to the supporting pouches and products held therein and are adapted to prevent the products from inadvertently falling through a side of the container, wherein products residing in the pouches can be accessed and emptied from the pouches of a second level when the user reaches downwardly through the open top and past the support members and supporting pouches of a first level, the support members and supporting pouches of the first level being moved towards the rear of the container.

11. The container of claim 10 further comprising at least one space limiter attached to the support members and limiting the distance adjacent support members may be spaced from each other.

12. The container of claim 10 wherein the container has multiple levels of support members.

13. The container of claim 10 further comprising stabilizers passing through the support members to prevent the support members from rotating.

14. The container of claim 10 wherein the support members are bars.

15. The container of claim 10 wherein the fabric of the pouches is sewn together to make a pocket in which a bar of a support member is located.

16. The container of claim 10 wherein at least one of the front and rear walls has a door.

17. A container for holding product therein during shipment, the container comprising:

a base;

a front wall, a rear wall and two side walls extending upwardly from the base and defining an open top, each of the side walls extending from the base to an upper edge of the open top of the container;

a plurality of straight tracks supported by each of the side walls at upper and lower vertically spaced levels; and a plurality of support members movable from front to back inside the container at each level and a plurality of supporting hanging pouches for holding products at each level, each of the support members having two end members at the ends thereof, the end members being adapted to move along the tracks remaining at the same level, wherein the two side walls are adapted to prevent side access to the supporting pouches and products held therein and are adapted to prevent the products from inadvertently falling through a side of the container, wherein products residing in the pouches can be accessed and emptied from the pouches of the lower level when the user reaches downwardly through the open top and past the support members and supporting pouches of the upper level, the support members and supporting pouches of the upper level being moved towards the rear of the container.

18. The container of claim 17 further comprising stabilizers for preventing rotation of the support members.

19. The container of claim 18 wherein opposed ends of the stabilizers are secured to opposed walls of the body.

20. The container of claim 17 wherein at least one of the front and rear walls has a door.

* * * * *